US007033105B2

(12) United States Patent
Catenacci et al.

(10) Patent No.: US 7,033,105 B2
(45) Date of Patent: Apr. 25, 2006

(54) ROAD PAVING EQUIPMENT TIRE TRACK REMOVER

(76) Inventors: John G. Catenacci, 3225 Franz Valley Rd., Santa Rosa, CA (US) 95404; Mark J. Tantarelli, 170 Larkfield Dr., Santa Rosa, CA (US) 95403; Samuel Franco, P.O. Box 643, Geyserville, CA (US) 95441; Frank D. Peterka, 1036 Rubicon Way, Santa Rosa, CA (US) 95401

( * ) Notice: Subject to any disclaimer, the term of this patent is extended or adjusted under 35 U.S.C. 154(b) by 0 days.

(21) Appl. No.: 10/826,024

(22) Filed: Apr. 15, 2004

(65) Prior Publication Data

US 2004/0208700 A1 Oct. 21, 2004

Related U.S. Application Data

(60) Provisional application No. 60/463,451, filed on Apr. 15, 2003.

(51) Int. Cl.
*E01C 19/42* (2006.01)
*E01H 5/04* (2006.01)

(52) U.S. Cl. ..... 404/101; 37/232; 37/269; 37/272; 172/684.5; 172/675; 172/701.1

(58) Field of Classification Search ..... 172/569, 172/574, 576, 134, 525, 684.5, 675, 701.1; 37/381, 142.5, 232, 233, 269, 272; 404/75, 404/90–94, 101, 110; 239/722, 723, 728

See application file for complete search history.

(56) References Cited

U.S. PATENT DOCUMENTS

| | | | | | |
|---|---|---|---|---|---|
| 1,260,174 | A | * | 3/1918 | Fisher | 172/574 |
| 1,818,656 | A | * | 8/1931 | Taylor et al. | 172/483 |
| 1,964,617 | A | * | 6/1934 | Bird | 37/232 |
| 2,141,558 | A | * | 12/1938 | Richter | 37/231 |
| 2,188,805 | A | * | 1/1940 | Borgeson | 37/231 |
| 2,277,880 | A | * | 3/1942 | Noble | 172/134 |
| 2,350,437 | A | * | 6/1944 | Wiedman | 37/231 |
| 2,431,410 | A | * | 11/1947 | Maxim | 37/231 |
| 2,582,136 | A | * | 1/1952 | Koblas | 37/263 |
| 2,590,143 | A | * | 3/1952 | Adams, Jr. et al. | 37/273 |
| 2,675,752 | A | * | 4/1954 | Wangsgard | 172/463 |
| 2,754,601 | A | * | 7/1956 | Meyer | 37/231 |
| 3,349,507 | A | * | 10/1967 | Payne | 37/231 |
| 3,357,499 | A | * | 12/1967 | Finneyfrock | 172/19 |
| 3,526,979 | A | * | 9/1970 | Ladewski | 37/273 |
| 4,209,068 | A | * | 6/1980 | Corsentino | 172/572 |
| 4,228,861 | A | * | 10/1980 | Hart | 172/662 |

(Continued)

*Primary Examiner*—Thomas B. Will
*Assistant Examiner*—Alexandra Pechhold
(74) *Attorney, Agent, or Firm*—Johnson & Stainbrook, LLP; Craig M. Stainbrook; Larry D. Johnson

(57) ABSTRACT

A road paving equipment tire track remover having a pair of blade assemblies, each including a semi-flexible blade with a lower edge and an upper edge. The upper edge is affixed to and shaped by a V-shaped frame so as to create a concave front side of the blade. The blade assembly is attached to the surface of a road paving vehicle near and behind the rear wheels of the vehicle in such a manner that the lower edge of the blade is in contact with the road surface. The blade assembly also includes a parallel scissors assembly to allow for vertical movement of the blade while in use, and a weight box to selectively adjust the pressure exerted by the blade on the road surface.

6 Claims, 6 Drawing Sheets

U.S. PATENT DOCUMENTS 4,255,884 A * 3/1981 Williams ..... 37/241
4,262,752 A * 4/1981 Parish ..... 172/574
4,731,942 A * 3/1988 Eberle ..... 37/272
4,907,358 A * 3/1990 Moore ..... 37/232
5,207,010 A * 5/1993 Grossman ..... 37/231
5,588,232 A * 12/1996 Renwick ..... 37/232
D377,653 S * 1/1997 Matisz et al. ..... D15/11
5,960,569 A * 10/1999 Molstad ..... 37/231
6,427,781 B1 * 8/2002 Buhler et al. ..... 172/134
6,516,544 B1 * 2/2003 Matisz et al. ..... 37/231
6,663,028 B1 * 12/2003 Malsam et al. ..... 239/722

* cited by examiner

ROAD PAVING EQUIPMENT TIRE TRACK REMOVER

CROSS REFERENCE TO RELATED APPLICATIONS

The present application claims the benefit of the filing date of U.S. Provisional Patent Application, Ser. No. 60/463,451, filed Apr. 15, 2003.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to road paving equipment, more particularly to a road paving equipment tire track remover.

BACKGROUND INFORMATION AND DISCUSSION OF RELATED ART

It is known to attach blades to vehicles for earth and snow removal, conditioning, and shaping operations. Typically, the blade comprises a concave blade body, customarily denominated the moldboard, extending transversely or slightly angled across the direction of vehicle travel. The blade is attached to the body or frame of a vehicle and is disposed in front of, underneath, or behind the vehicle, where it engages and digs into the surface worked on to move the surface substrate in a desired direction. Most often, the blade is fabricated of steel or other relatively hard material so that it is not damaged by rocks, wood, artifacts and man made debris, and various objects routinely found on the ground or in a road bed. When used for plowing or scraping, the blade is capable of leaving a substantially smooth surface. Examples of such apparatus may be found in, for example, U.S. Pat. No. 4,521,980 to Solaja, issued Jun. 11, 1985, which discloses an attachment for a loader wherein the loader can additionally perform the function of a grader. The attachment comprises an elongated body member, a lateral slot in the body member for engagement with a bucket of a loader, and a blade extending laterally of the body member.

U.S. Pat. No. 5,775,012 to Hockensmith, issued Jul. 7, 1998, teaches a hitch adjustable rear blade hitched to the back of a tractor for earth grading operations. The blade has an elongated cylindrical skid releasably mounted to the back of the blade adjacent the leading edge of the blade and a pair of spaced apart stabilizer springs adjustably mounted to the front of the blade holding the blade in tension.

U.S. Pat. No. 5,265,975 to Scott, issued Nov. 30, 1993, shows a combination scarifier/grading device comprising a scarifier having a plurality of scarifying teeth, a grading blade having a mold board and a cutting edge, and a second frame interconnecting the scarifier frame and the blade in mutually spaced apart relation with the scarifier in operably leading relation and the blade in operably trailing relation. The scarifier includes height-adjusting means for selectively raising and lowering the scarifying teeth relative to the cutting edge. The height-adjusting means comprises an at least one hydraulic cylinder.

On a much larger scale, graders prepare road surfaces to grade. However, graders leave tire tracks in gravel and new asphalt, so it is also well known to employ rakes to smooth and level tire tracks made by road construction equipment on gravel and asphalt surfaces. The blades discussed immediately above are not well-suited for this task, so it invariably falls on road crews to do the work manually. Most disturbingly, because of the nature of the work, road crew assigned to the task of raking track marks typically ride on the rear of the grader, both during operations in the field and while traveling to and from the work site. This is dangerous and, less obviously, needlessly labor intensive and expensive: needlessly because an automated rake would eliminate the need for (typically) two manual laborers.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

Accordingly, it remains desirable to provide an inexpensive and simple method and apparatus for mechanically raking and smoothing grader or other vehicle tire tracks created during road grading operations.

OBJECTS AND ADVANTAGES

To address the above-described need, it is an object of the road paving equipment tire track remover of the present invention to provide an inexpensive tool that eliminates the need for manual raking and smoothing of tire tracks caused by road-making equipment during paving and road surface preparation operations.

It is another object of the present invention to provide a tire track remover that has means for adjusting the downward pressure exerted by the tool when in use.

It is yet another object of the present invention to provide a tire track remover that can be quickly and easily coupled to a hydraulically-actuated attachment assembly.

It is still another object of the present invention to provide a tire track remover that has few moving parts and lends itself to easy repair and maintenance.

It is a further object of the present invention to provide a tire track remover that includes a scraper blade that will conform to road surface changes and accommodate reasonable and acceptable variations in road surface unevenness by bending and/or moving reciprocally upward and downward as variations are encountered.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention does not reside in any one of these features taken alone, but rather in the particular combination of all of its structures for the functions specified.

There has thus been broadly outlined the more important features of the invention in order that the brief summary of the invention and the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF SUMMARY OF THE INVENTION

The present invention is a road paving equipment tire track remover comprising a pair of blade assemblies positioned immediately behind the rear wheels of a grader on a ripper frame. Each of the blade assemblies includes a semi-flexible blade attached to a V-shaped frame. The blade assemblies are attached to the ripper frame with a expansible scissors assembly which allows vertical movement of the blade during operations. The blade itself is swivellingly connected to a strut depending downwardly from the scissors assembly and terminating in a post having an arcuate throughhole through which a bolt passes. This allows for side-to-side rocking movement of each side of the blade. The post is then connected to a box having an opening for the placement of plank-shaped weights to vary downward pressure exerted by the blade onto the road surface.

The blade is semi-flexible, preferably fabricated from rigid rubber material which has some play in both the longitudinal and vertical directions. Play in the vertical direction is provided by parallel bar expanding mechanism (akin to a scissors gate or lazy tongs), which is, in turn, welded or otherwise attached to a hydraulically-actuated ripper bar or frame. When the ripper frame is lowered so that the lower edge of the blade engages the road surface, the parallel bars pivot to allow some give from the blade, depending on the amount of weight selectively placed in the blade's weight box. Play at the edges is governed by side-to-side movement of the blade as allowed by the pivot point defined by the arcuate slot in the post. Collectively, these features allow careful tailoring of blade movement and behavior during operations. Specifically, according to the paving material employed, they permit the blade to maintain a controllably small inventory of paving material in front of the blade and thus available for leveling out minor work surface irregularities and tire track marks as the blade passes over them. The play also permits excess substrate material collected on the blade and/or large objects to pass under the blade. Thus the blade will continue to fill tire tracks unless and until it is overloaded with material or engages an object too large to blend into the paving material, in which event it will be biased upwardly to allow the object or material to pass under the blade. Accordingly, its performance will not be adversely affected by material accumulation during operations.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawing wherein.

DRAWING LEGEND

Figure 1:
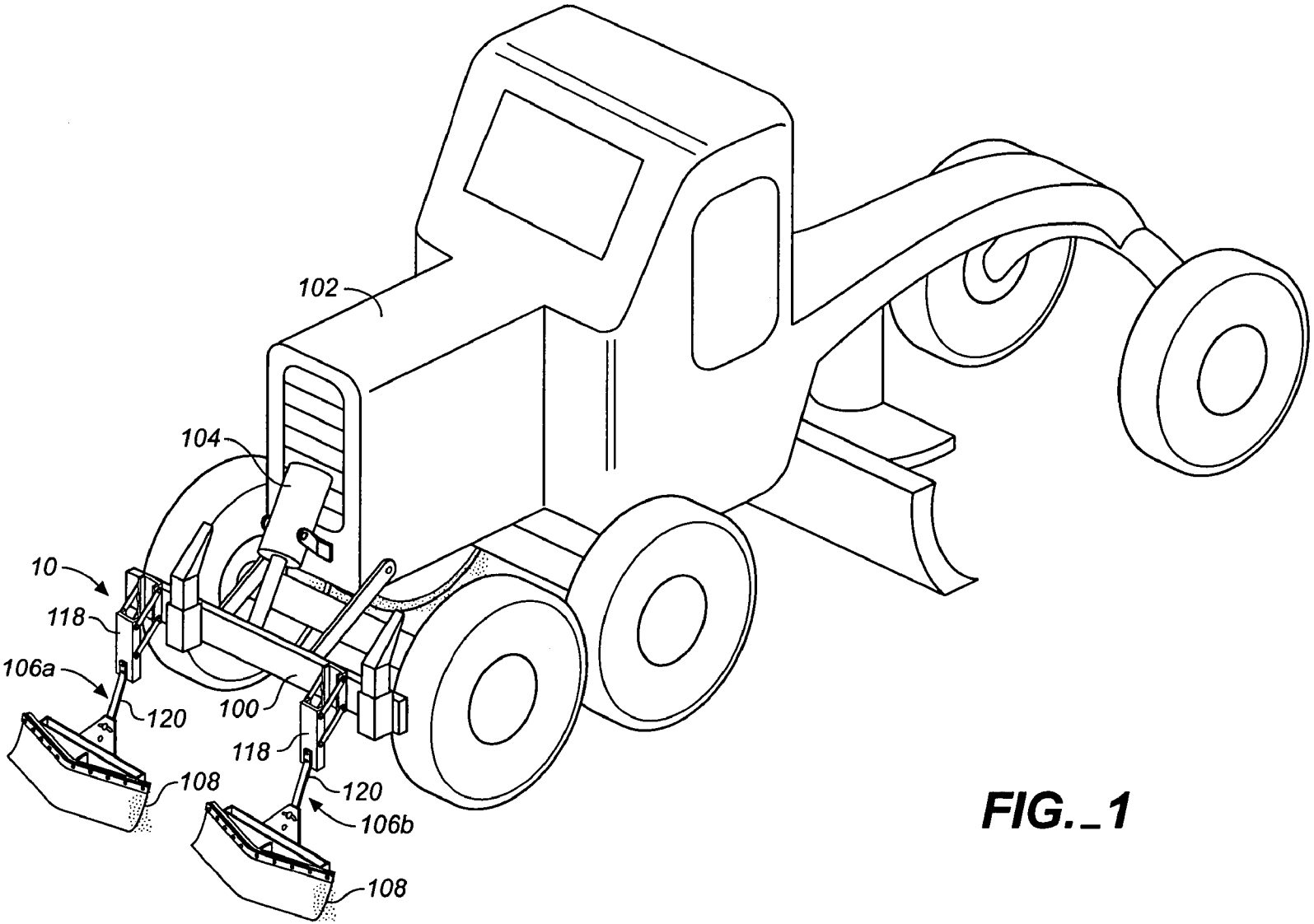
FIG. 1 is a perspective view of a grader having the paving equipment tire track remover of the present invention mounted on a hydraulically-actuated frame member at the rear of the grader.
Figure 2:
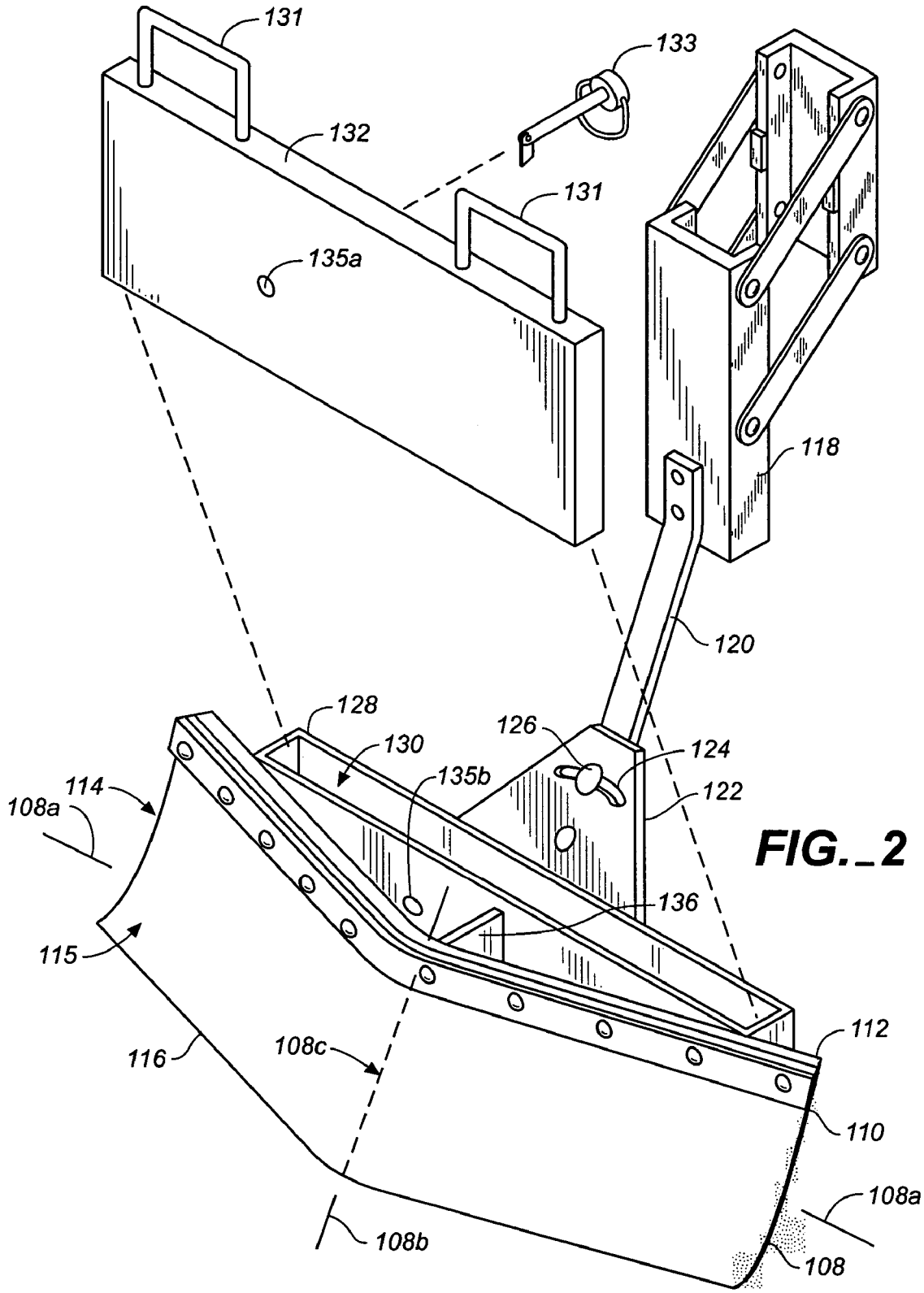
FIG. 2 is a perspective view showing the inventive apparatus in isolation.
Figure 3:
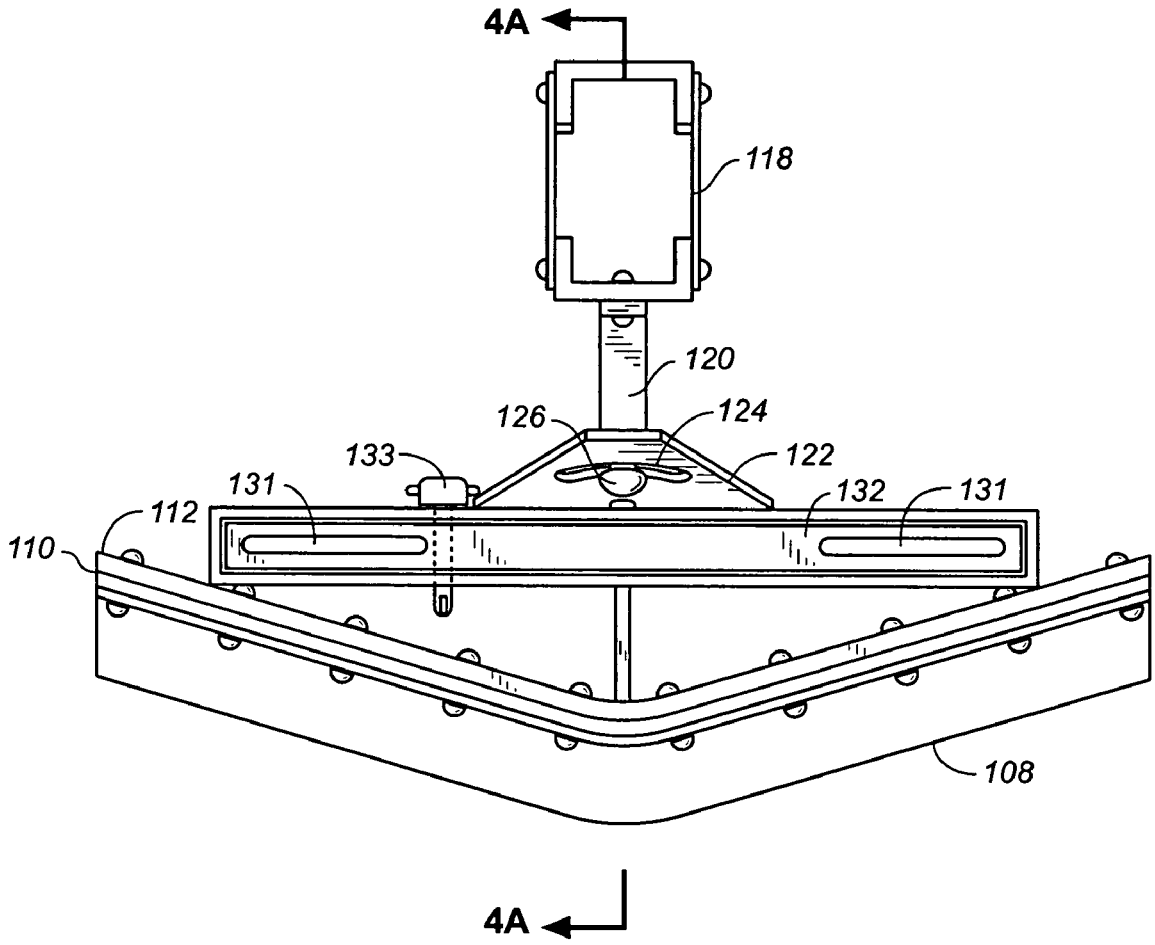
FIG. 3 is a top view of the apparatus of FIG. 2.
Figure 4A:
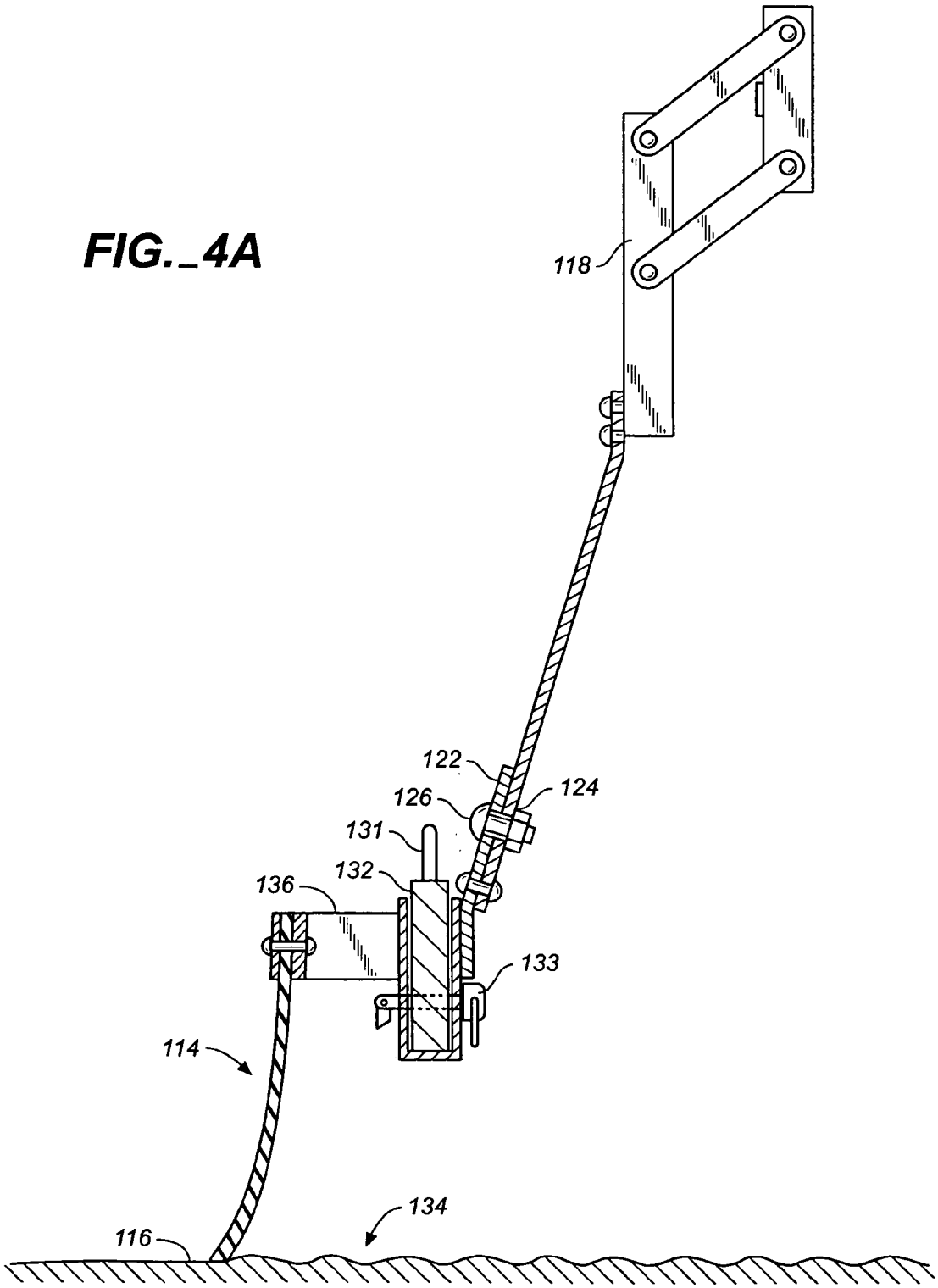
FIG. 4A is cross-sectional side view in elevation thereof, showing the attachment assembly scissors gate in a slightly retracted configuration, said section taken along the section lines defined in FIG. 3.
Figure 4B:
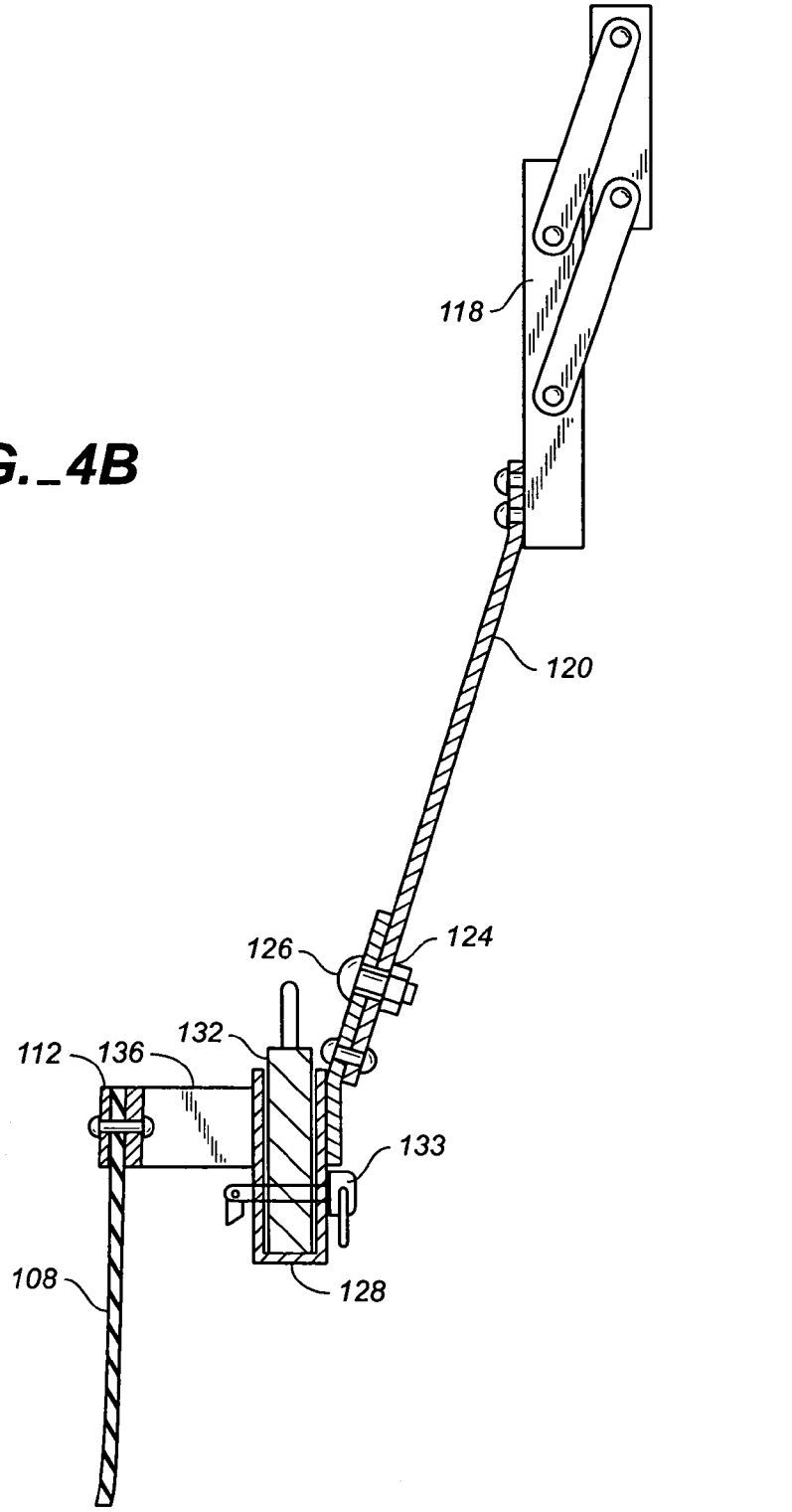
FIG. 4B is a cross-sectional side view in elevation thereof, showing the attachment assembly scissors gate in a fully extended configuration, said section also taken along the section lines defined in FIG. 3.

10 inventive apparatus generally
100 ripper frame
102 grader
104 hydraulic piston
106*a–b* first and second blade assemblies
108 semi-flexible blade
108*a* horizontal axis of semi-flexible blade
108*b* vertical axis of semi-flexible blade
108*c* center of horizontal axis
110 upper edge of semi-flexible blade
112 V-shaped blade frame
114 concave rear side of semi-flexible blade
115 front side of semi-flexible blade
116 lower edge of semi-flexible blade
118 parallel scissors assembly
120 strut member
122 triangular post
124 throughhole
126 attachment means
128 box
130 upper opening in box
131 handles for blocks

132 weights or blocks
133 locking pins
134 road surface
135*a–b* apertures
136 longitudinal strut

DETAILED DESCRIPTION OF THE INVENTION

Referring to FIGS. 1 through 5, wherein like reference numerals refer to like components in the various views, there is illustrated therein a new and improved road paving equipment tire track remover, generally denominated 10 herein.

Figure 5:
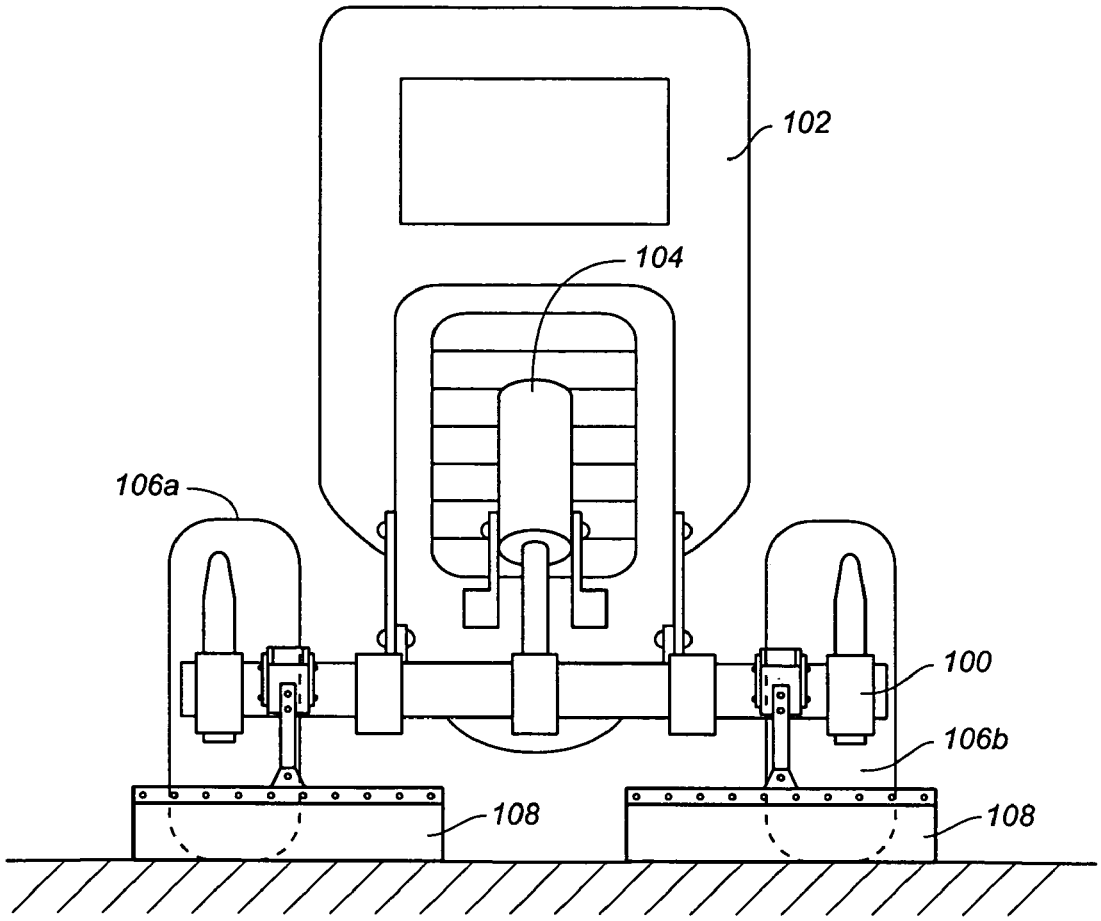
FIG. 5 is a rear view in elevation of the inventive apparatus mounted on a grader ripper frame with the frame lowered into position so that the blades engage the paving surface.

FIGS. 1 and 5 show that the inventive apparatus 10 is adapted for mounting proximate the rear wheels of road paving equipment. For example, the apparatus may be mounted on a ripper frame 100 of a grader 102. The ripper frame, or other suitable attachment surface, is preferably hydraulically-actuated by at least one driver-controlled hydraulic piston 104, though manual functioning is disadvantageous only in the ease of use. The tire track remover comprises at least one blade assembly, preferably first and second blade assemblies 106*a*, 106*b*, each of which includes a semi-flexible blade 108 captured or otherwise attached at its upper edge 110 to a V-shaped blade frame 112. In operation and during forward movement of the road paving vehicle, the rear side 114 of the blade is urged into an arc and is therefore concave relative to its horizontal axis 108*a*, the degree of concavity depending upon the pressure exerted upon the lower edge 116 of the blade. The shape of front side 115 of blade 108 generally conforms to the V-shaped frame 112 to which the blade's upper edge is affixed, and it is concave relative to the blade's vertical axis 108*b*, which is substantially perpendicular to the center 108*c* of the horizontal axis of the blade. This creates a generally symmetrical leading side such that road paving material is collected and urged to the center of the blade in a generally balanced manner as the paving vehicle moves forward.

FIGS. 2 through 4B provide more detailed views of the inventive apparatus, collectively showing that the tire track remover is attached to a ripper frame with a parallel scissors assembly 118 which provides for vertical play or movement of the blade assemblies to conform to road irregularities. Depending downwardly from the scissors assembly is at least one strut member 120 to which a truncated triangular post 122 having an arcuate throughhole 124 is pivotally connected with a rivet, bolt, or other attachment means 126.

Post 122 is next connected to a box or trough 128 defining an upper opening 130 into which heavy blocks 132 of varying weights may be disposed to adjust the amount of downward pressure exerted onto the road surface 134 by the blade during operation. The blocks preferably include handles 131 which facilitate manipulation of the blocks. Additionally, locking pins 133 may be provided and inserted through coaxial apertures 135*a*, 135*b* to secure blocks 132 in box 128. The V-shaped frames 112 at the upper edge 110 of the blade assemblies 118 is secured to the rear of the box with attachment means, preferably bolts or other hardware that allows for easy removal and replacement of the flexible blade portion 108.

Finally, a longitudinal strut 136 is interposed between the weight box 128 and the blade frame 112 so as to provide structural support and to define the degree of inward angle from the outside edges of the blade to the geometric center of the blade, and thus the rapidity with which material is channeled to the center of the blade. This, too, may be adjusted according to the paving material used in the paving operations.

As will be readily appreciated from the foregoing description, the paving equipment tire track remover of the present invention is dragged behind paving equipment during paving operations. The weight of the assembly, and any additional weight provided by the blocks placed in box 128, press the flexible blades into soft and movable paving material. To the extent that loose material is collected by the blades, it is partly swept into tire track depressions and partly accumulated in front of the moving blades. The shape of the blade channels material into the general location of the tire tracks, and the blade assemblies are positioned on the equipment to optimize this channeling effect according to the areas where tire tracks are formed.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. In fact, and as will be appreciated by those with skill in the art, distilled to its essence, the present invention is a road paving vehicle track remover comprising at least one blade assembly having a semi-flexible blade with a lower edge and an upper edge, the upper edge being attached to a frame so as to create a concave front side of the blade. Means are provided for removably attaching the blade assembly to a road paving vehicle on a surface proximate the rear wheels of the vehicle such that the blade assembly is disposed downwardly and the lower edge of the blade comes into contact with the road surface. The assembly is provided with height adjustment means for adjusting the height of the blade assembly; and pressure adjustment means for adjusting the downward pressure exerted by the blade assembly on the road surface.

Therefore, the above description and illustrations should not be construed as limiting the scope of the invention, which is defined by the appended claims.

What is claimed as invention is:

1. A road paving vehicle tire track remover, comprising:

a blade frame having a bend;

at least one blade assembly having a semi-flexible blade with a lower edge and an upper edge, a front side and a rear side, a vertical axis and a horizontal axis, said upper edge attached to said blade frame so as to generally conform to said bend in said blade frame such that said front side of said semi-flexible blade is generally concave about said vertical axis, and further including pivoting means for allowing side-to-side rocking movements of said semi-flexible blade, said pivoting means comprising a strut member attached to a height adjustment means, a post having an arcuate throughhole through which a fastener is inserted for connection to a lower end of said strut, and wherein said post is connected to said blade frame, such that said blade assembly pivots about said fastener;

attachment means for removably attaching said blade assembly to a road paving vehicle on a surface proximate the rear wheels of the road paving vehicle, such that said blade assembly is disposed downwardly and said lower edge of said semi-flexible blade can be brought into contact with the road surface when in operation;

said height adjustment means permits vertical movement of said blade assembly during use; and pressure adjustment means for adjusting the downward pressure exerted by said blade assembly on the road surface;

wherein when in use said semi-flexible blade, height adjustment means, and pressure adjustment means cooperate to press said semi-flexible blades into soft and movable paving material, thereby collecting and channeling loose road paving material toward said vertical axis of said semi-flexible blade, and smoothing the road surface as said semi-flexible blade passes over it.

2. The tire track remover of claim 1, wherein said rear side of said semi-flexible blade is urged into an arc and is therefore concave relative to its horizontal axis, the degree of concavity depending upon the pressure exerted upon said lower edge of said semi-flexible blade.

3. The tire track remover of claim 1, wherein said semi-flexible blade is generally symmetrical about said vertical axis such that road paving material is urged toward said vertical axis in a generally balanced manner as the road paving vehicle moves forward.

4. The tire track remover of claim 1, wherein said bend in said blade frame is adjustable and wherein said tire track remover further includes a longitudinal strut affixed to said blade frame to provide structural support and to define the degree of said bend.

5. The tire track remover of claim 1, wherein said height adjustment means is a parallel scissors assembly which provides for vertical play or movement of the blade assembly to conform to road irregularities.

6. The tire track remover of claim 1, wherein said pressure adjustment means comprises a box attached to said blade assembly, said box having an open top for receiving weights.

* * * * *